United States Patent [19]

Shimoma et al.

[11] Patent Number: 4,689,525

[45] Date of Patent: Aug. 25, 1987

[54] COLOR CATHODE RAY TUBE DEVICE

[75] Inventors: Taketoshi Shimoma, Isezaki; Kumio Fukuda, Hyogo, both of Japan

[73] Assignee: Kabushiki Kaisha Toshiba, Kawasaki, Japan

[21] Appl. No.: 892,437

[22] Filed: Aug. 4, 1986

[30] Foreign Application Priority Data

Aug. 19, 1985 [JP] Japan ..... 60-180512

[51] Int. Cl.[4] ..... H01J 29/56

[52] U.S. Cl. ..... 315/370; 315/368; 313/412

[58] Field of Search ..... 313/412; 315/368, 370

[56] References Cited

U.S. PATENT DOCUMENTS 3,984,723 10/1976 Gross et al. ..... 313/412

4,142,131 2/1979 Ando et al. ..... 313/412

*Primary Examiner*—Theodore M. Blum

*Attorney, Agent, or Firm*—Oblon, Fisher, Spivak, McClelland, & Maier

[57] ABSTRACT

A color cathode ray tube device in which three electron beams are generated so that they are arranged in-line in a horizontal plane to impinge through a shadow mask on a phosphor screen consisting of red, green and blue phosphors. These beams are generated practically parallel. In the deflection device that deflects the electron beams, the horizontal deflection magnetic field is made uniform and the vertical deflection magnetic field is made barrel shaped on the electron gun side and pincushion shaped on the phosphor screen. The half-width a of the magnetic flux distribution on the tube axis of the horizontal deflection magnetic field is set so that $a/A=0.1$ to 0.4, where A is the distance from the center of the magnetic flux density distribution to the phosphor screen surface. It is arranged that the picture signals modulating the respective beams are not mutually time-wise offset since the three electron beams are parallel. Thus little electron beam spot distortion is obtained over the whole picture screen.

7 Claims, 19 Drawing Figures

SCREEN CENTER

SCREEN PERIPHERY

SCREEN CENTER

SCREEN PERIPHERY

SCREEN CENTER

SCREEN PERIPHERY

COLOR CATHODE RAY TUBE DEVICE

BACKGROUND OF THE INVENTION

This invention relates to a color cathode ray tube device with an in-line electron beam arrangement.

The envelope of a color cathode ray tube device generally consists of: a neck in which are installed three electron guns that generate three electron beams and are aligned in the horizontal direction; a face plate having a phosphor screen; and a funnel disposed between the neck and the face plate.

The three electron beams generated from the in-line type electron guns, mounted in a horizontally in-line arrangement, are directed onto the phosphor screen, which is formed coated with phosphor layers, causing the phosphor layers to emit light. In order to achieve good color reproduction with the light emitted from the phosphor layers, the electron beams must be made to impinge selectively on prescribed phosphor layers. This is achieved by arranging a shadow mask formed with a large number of apertures close to the face plate.

The in-line electron guns incorporate separate cathodes and are designed so as to generate three electron beams in a common horizontal plane and bring them to convergence in the vicinity of the face plate. Known methods of bringing the three electron beams to convergence include for example the technique disclosed in U.S. Pat. No. 2,957,106 (Moodey), in which the side beams in the electron beams emitted from the cathodes are bent from the start, and the technique disclosed in U.S. Pat. No. 3,772,554 (Hughes), in which apertures are provided in the electron beam electrodes for passage of the three electron beams, the electron beams are converged by, and displacing those apertures which are on both sides of the part of an electrode slightly to the outside from the centre axes of the electron guns. This bends the electron beam by creating a potential gradient in the electric field generated at the displaced portions. Both these methods are widely used.

To make the phosphor screen of a color cathode ray tube display a TV picture, the electron beams must be scanned over the entire surface of the phosphor screen. This is done by mounting a deflection device outside the cone portion of the funnel. Essentially the deflection device comprises horizontal deflection coils for generating a horizontal deflection magnetic field that deflects the electron beam in the horizontal direction, and vertical deflection coils for generating a vertical deflection magnetic field that deflects the electron beam in the vertical direction. In practical color cathode ray tubes, when the electron beams are deflected by a uniform magnetic field, because of the leakage field that extends beyond the end surface of coils, convergence of the three electron beam spots on the face plate is lost. Various countermeasures have to be adopted to deal with this, so that the spots always converge over the whole surface of the screen. Such a system is termed a "convergence free system" In this system, convergence of the three electron beams over the entire phosphor screen is achieved by making the horizontal deflection magnetic field of pin-cushion form, and making the vertical deflection magnetic field of barrel form. If the vertical magnetic field is uniform, there is over-convergence which increases in degree from the center of the screen towards the top and bottom ends, but with a barrel-type magnetic field, convergence can be achieved over the entire screen. As a result, with such a system, a parabolic current generating circuit for convergence compensation and a convergence yoke for generating a convergence compensating magnetic field can be dispensed with, conferring many advantages such as cost saving and productivity gain.

As explained above, the quality of color cathode ray tubes has been improved by many technical developments. However, as large tubes have become common, fresh problems have come to the fore.

One of these problems concerns the shape of the beam spot where the electron beams are brought to convergence on the face plate after being emitted from the electron guns. As shown in FIG. 5(*a*), in the middle of the screen, where the beams are not subjected to any deflection, the spot $S_{5a}$ consists simply of a round core Sc, i.e. a region of high electron density. However, as shown in FIG. 5(*b*), due to non-uniformity of the deflection magnetic field, in the peripheral regions of the screen, where the spot $S_{5b}$ is subject to deflection, the spot presents a flattened core $S_c$ with vertically extending flares $S_f$(i.e. portions of lower electron density). As a result, the electron beam size increases at the edges of the screen, producing a deterioration in focussing property and resolution.

Specifically, if we take the horizontal dimension of the core for the case of a 20 inch 90 degree deflection tube as $C_H$ and its vertical dimension as $C_V$, in the middle of the screen $C_H=C_V=1.0$ mm, but at the extreme end region of the horizontal deflection the core has a very flattened shape with $C_H=20$ mm and $C_V=0.3$ mm. Also, the dimension $F_V$ from the top to the bottom of the flares is 1.5 mm. These values are for the case where the electron beam is deflected in the horizontal direction only. In the corners of the screen, where a vertical deflection is added to the horizontal deflection, the dimensions are even more distorted. The inventors have provided in the co-pending application Ser. No. 865,352 filed May 21, 1986, entitled a color cathode ray tube device in which three electron beams emitted from the electron gun are substantially parallel, the horizontal deflection magnetic field forms a uniform field distribution, the vertical deflection magnetic field forms a barrel shaped magnetic distribution and the half-width on the tube axis, of the magnetic flux density distribution of the horizontal deflection magnetic field is selected in certain range. However, still more superior quality is desired.

SUMMARY OF THE INVENTION

It is an object of this invention to provide a bright color cathode ray tube device which overcomes the abovementioned drawbacks, wherein high resolution is obtained over the whole area of the screen with little distortion of the electron beam spot at the peripheral parts of the screen.

According to this invention, a color cathode ray tube device comprises:

- an enclosed envelope including a face plate, a funnel portion sealed to the face plate and a neck portion connected to the funnel;
- a phosphor screen on the inside of the face plate for emitting light in the three colors red, green and blue;
- electron gun means in said neck for generating three substantially parallel electron beams in a direction toward the phosphor screen;

a shadow mask disposed in said envelope, including a plurality of apertures for selective impingement of the electron beams on the screen; and deflection means both for deflecting the electron beams from a substantially parallel orientation and for maintaining a substantially equal relative distance between adjacent electron beams at any given point of intersection of the beams with the phosphor sccreen, the deflection means including; means for generating a horizontal deflection magnetic field having a substantially uniform magnetic field distribution; and means for generating a vertical deflection magnetic field having a first portion of substantially barrel-shaped magnetic field distribution and a second portion of substantially pin-cushion shaped magnetic field distribution.

The vertical deflection magnetic field forms a barrel-shaped magnetic field distribution on the electron gun means side and a pin-cushion shaped magnetic field distribution on the screen side in the space surrounded by the deflection coils. Almost all of the deflection magnetic field distribution is located in the space surrounded by deflection coils.

The half-width a of the magnetic flux density distribution of the horizontal deflection magnetic field on the tube axis is within the range 0.1 to 0.4 times the distance A from the center of this flux density distribution to the phosphor screen. A better effect is obtained when the range a is 0.2 to 0.3 times the value of A. The best characteristic is shown when a is about 0.25 times the value of A.

By having respective time delays in the times at which these three picture signals for the colors red, green and blue to the electron guns are controlled, the picture information of the three electron beams are made to converge on or near the face plate.

Little electron beam spot distortion is obtained by the combining of the vertical deflection magnetic field and a time delay to the input picture signals.

BRIEF DESCRIPTION OF THE DRAWINGS

FIG. 10(*b*) is a schematic view explaining the residual beam convergence error distribution after Δc correction.

FIG. 10(*c*) is a schematic view showing the beam convergence error distribution in a direction of the upper and lower side.

FIG. 10(*d*) is a graph showing components of the magnetic distribution.

PREFERRED EMBODIMENT OF THE INVENTION

This invention will now be described with reference to the results of experiments carried out by the inventors with a color cathode ray tube.

Figure 2:
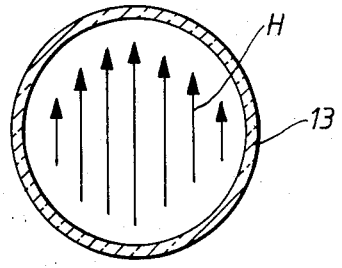
FIG. 2 is a cross-sectional view shown sectioned along the line A of FIG. 1 to explain a horizontal deflection magnetic field.
Figure 6A:
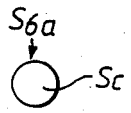
FIGS. 6(*a*) (*b*), FIGS. 8(*a*) (*b*) and FIGS. 9(*a*) (*b*) are views given in explanation of the shape of the electron beam spot according to this invention.
Figure 6B:
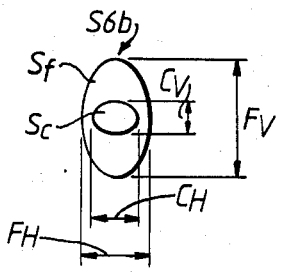

Noting that one of the factors producing distortion of the electron beam spot at the periphery of the screen is the pin-cushion shape of the horizontal deflection magnetic field, the inventors tried making the horizontal deflection magnetic field uniform, while maintaining the the vertical deflection magnetic field barrel shaped. FIGS. 6(*a*) and 6(*b*) respectively show the electron beam spot shapes $S_{6a}$ and $S_{6b}$ at the center of the screen and the at periphery of the screen for a uniform horizontal deflection magnetic field H as shown in FIG. 2. In a 20 inch 90 deflection tube, $C_H=1.5$ mm, and $C_V=0.6$ mm, and it can be seen that the shape of the region of high electron density i.e. the core $S_c$ is much improved.

However, the shape of this electron beam spot is still not fully satisfactory.

It has been found that if a prescribed relationship between the magnetic flux density distribution of the deflection magnetic field and the size of the color cathode ray tube is established, the shape of the flares $S_f$ around the core $S_c$ can be further improved.

Figure 4:
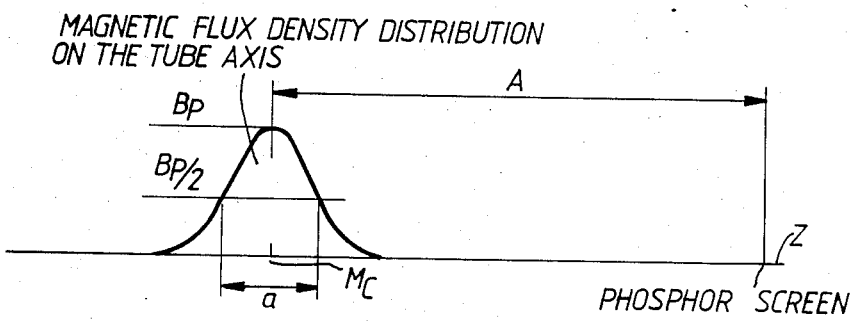
FIG. 4 is a view given in explanation of the magnetic flux density distribution on the tube axis Z of the horizontal deflection magnetic field according to this invention.
Figure 5A:
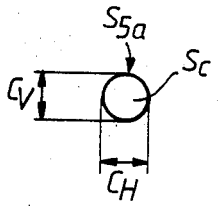
FIG.5(a). PRIOR ART
FIG. 5 is a view given in explanation of the shape of the electron beam spot in the conventional device.
Figure 5B:
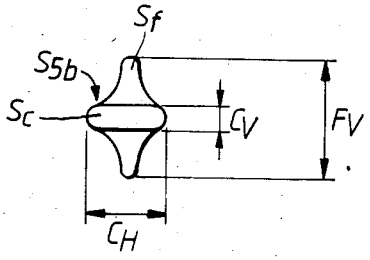
FIG.5(b). PRIOR ART

FIG. 4 shows the relationship of the magnetic flux density distribution of a uniform horizontal deflection magnetic field on the tube axis Z with the distance from the center of this distribution to the phosphor screen.

Figure 7:
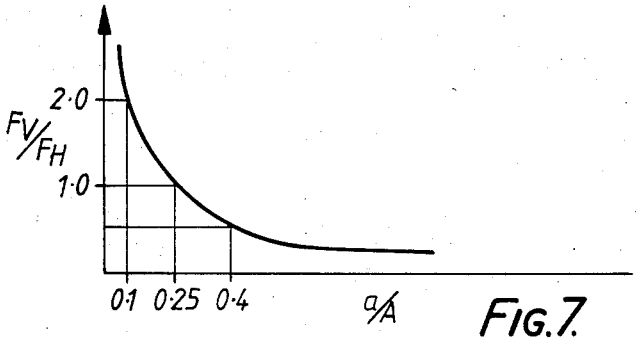
FIG. 7 is a graph given in explanation of the relationship between the deflection magnetic field according to this invention and the shape of the electron beam spot.

The center of the flux density distribution is defined as the position showing the maximum value $B_p$ of the flux density distribution. The magnetic path length is defined a as the length determined by the width between the points where the value is half the maximum value $B_p$, and A as the distance from the center $M_c$ of the flux density distribution to the face plate. The spot $S_{6a}$ at the center of the screen is shown in FIG. 6(*a*), and is core $S_c$. As shown in FIG. 6(*b*), when spot $S_{5b}$ having flares $S_f$ is formed at the screen periphery, the dimension of the horizontal direction of the flares is $F_H$ and the dimension of the vertical direction is $F_V$. It was found that in this case the relationship shown in FIG. 7 exists between a/A and $F_V/F_H$. Having ascertained that it is necessary that the value of the $F_V/F_H$ when evaluated from the practical point of view should be at least 0.5 and not more than 2.0, when this is substituted in FIG. 7, the practical range of a/A is from 0.1 to 0.4. Preferably the range of a/A is 0.2 to 0.3. The most ideal condition is obtained when $a/A \simeq 0.25$, when the flares $S_f$ are circular and at their minimum size.

Figure 8A:
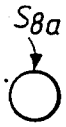
Figure 8B:
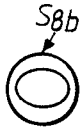
Figure 9A:
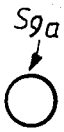
Figure 9B:
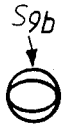
Figure 10A:
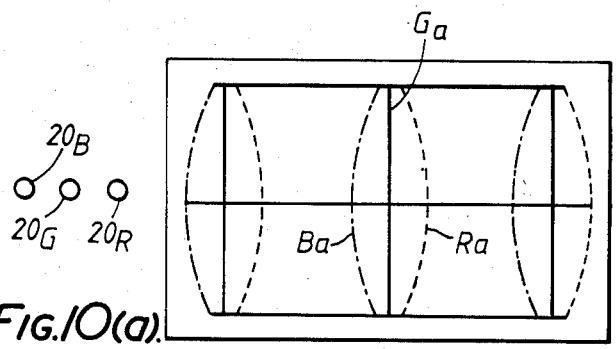
FIG. 10(*a*) is a schematic view explaining the beam convergence error distribution of deflection according to this invention.
Figure 10B:
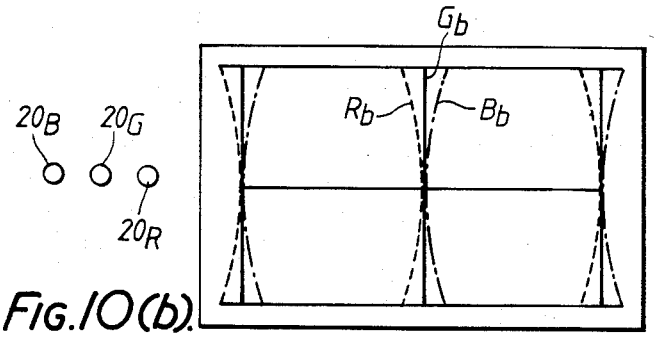
Figure 10C:
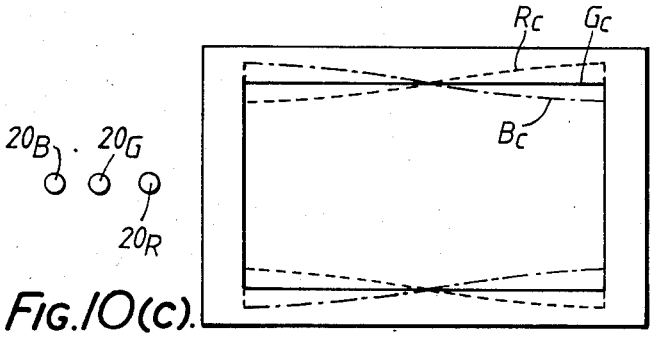
Figure 10D:
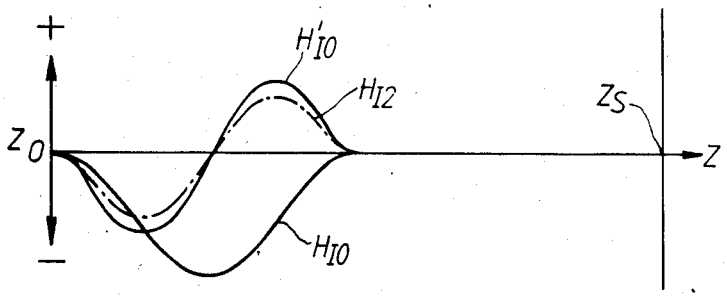

FIGS. 8(*a*) and 8(*b*) show respectively the shapes $S_{8a}$ and $S_{8b}$ of the electron beam spot at the center and at the periphery of the screen when $a/A \simeq 0.25$. To further improve the electron beam spot shape $S_{8b}$ in FIG. 8(*b*) at the peripheral regions of the screen, the focal point distances of the electron lenses of the electron guns are adjusted at the peripheral regions of the screen. Spot $S_{9b}$ in FIG. 9(*b*) shows as example of the improvement which this makes possible. As shown by $S_{9a}$, the shape of the spot at the center of the screen is unchanged.

The electron beam spot shape is further improved by the above construction. Convergence of the three electron beams over the entire surface of the face plate is further improved in the above construction of this invention by making the three electron beams generated from the electron guns practically parallel and providing a time delay in the times with which the signals that are applied to the three electron guns are mutually controlled.

The method by which this is done will now be described. When the various color picture signals are input at the same time to the three electron guns, the electron beam spots on the face plate are separated from each other by a constant amount Δc. FIG. 10(*a*) shows the patterns of red Ra, green Ga and blue Ba at the time, while the arrangement of 20B, 20G, 20R is the beam relative positions on the electron gun. The time at which the signal is applied to the second electron gun is delayed by a time τc with respect to the time at which the signal is applied to the first electron gun, and time at which the signal is applied to the third electron gun is delayed by a time τc with respect to the time at which the signal is applied to the second electron gun. If we let the horizontal width of the screen be H, the horizontal deflection frequency be $f_H$, and the constant determined by the overscan be C, by making the delay time $\tau c = C \cdot \Delta c / f_H H$, electron beam spot convergence error can be corrected by Δc over the whole area of the screen, where Δc is a convergence error at the center area of the screen.

There are some cases where the convergence error remains even though the correction is practiced.

Such residual convergence error has two types. One is a convergence error in the horizontal direction occurring at the upper and lower ends of the screen as shown in FIG. 10(*b*). The patterns Rb, Gb and Bb show the respective raster pattern for red, green and blue, when the beams 20B, 20G and 20R on the gun are arranged as shown in the figure. The convergence error ΔD is expressed with the equation:

$$\Delta D = k \cdot Y^2$$

where Y is amount of vertical deflection.

Thus, required delay time τD is given by:

$$\tau D = \frac{C}{f_H H} \cdot \Delta D = \frac{C \cdot k}{f_H H} \cdot Y^2$$

and τD increases with amounts proportional to the second power of the amount of the vertical deflection.

Total delay time τ is given by:

$$\tau = \tau C + \tau D(Y^2).$$

As a result, since is modulated and synchronized with the vertical deflection, the convergence error Δ(=ΔC+ΔD) is perfectly corrected.

The other type of the residual convergence error is a convergence error in the upper and lower direction occurring at the four corners of the screen as shown in FIG. 10(*c*), where the pattern Rc, Gc and Bc represent the respective raster pattern for red, green and blue. The pattern 20B, 20G and 20R shows the position of beams generated from the electron gun.

In the case that the three electron beams generated from the electron gun are substantially parallel with each other and the horizontal deflection field is substantially uniform, the convergence error ΔV is given by:

$$\Delta V = C \cdot \int_{Zo}^{Zs} [2(Zs - Zo)H_{I2} - H'_{I0}]XdZ$$

where

Z is the tube axis of the color cathode ray tube,

Zo is the point of origin of the deflection,

Zs is the position of the screen,

X is a component in the horizontal direction in the beam path of which the electron beam is deflected towards the corner of the screen, $H_{I0}$ is the intensity distribution of the vertical deflection field on the tube axis Z and $H'_{I0}$ is a first differential coefficient relating to Z.

Also $H_{I2}$ is a parameter representing non-uniformity of the vertical deflection field, $H_{12}>0$ indicates a pin-cushion type field and $H_{12}<0$ indicates a barrel type field.

In this equation, for satisfying ΔV=0, the following relation is required:

$$H_{I2} = \frac{H_{I0}}{2(Zs - Zo)}$$

It is noted that HI0 must be negative for the beam to be deflected to the upper right area of the screen (FIG. 10(*d*)).

Since HI2 is the same sign as HI0, the sign of HI2 has to be the plus on the screen side and the minus on the electron gun side. In other words, non-uniformity of the vertical deflection magnetic field shows the barrel shape on the side of the electron gun and the pin-cushion shape on the side of the phosphor screen.

As mentioned above, the convergence error in the upper and lower direction at the upper right corner of the screen is reduced by the non-uniformity of the vertical deflection field. Such reduction is given at any corner of the screen by the non-uniformity of the field which has the barrel shape on the electron gun side and has the pin-cushion shape on the phosphor screen side. Consequently, the second residual convergence error is easily reduced within the practically permissible range.

Figure 1:
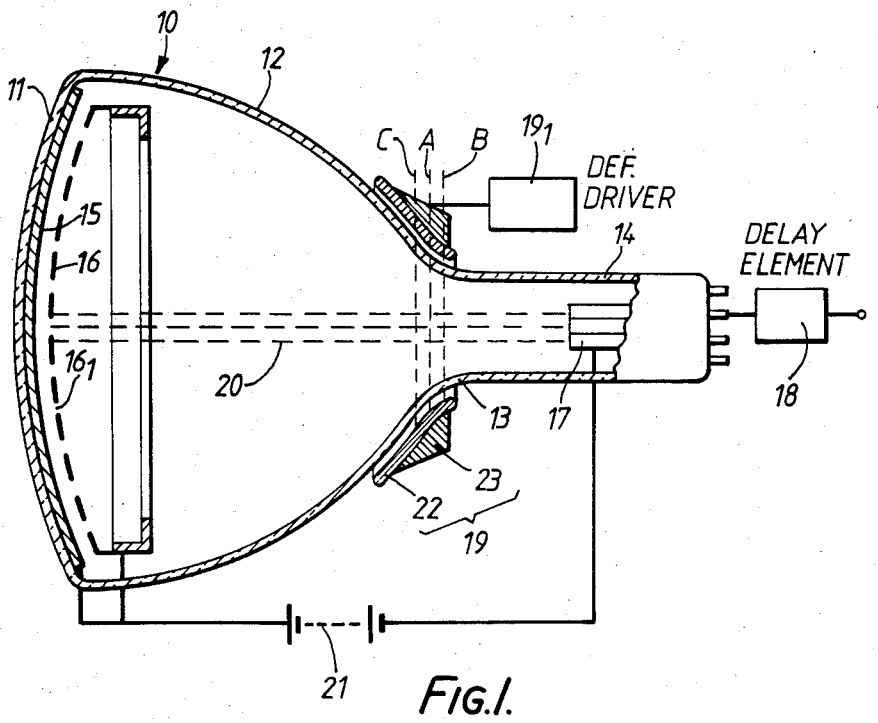
FIG. 1 is a cross-sectional view of an embodiment of this invention.

FIG. 1 shows a 20 inch color cathode ray tube with 90 degree deflection according to an embodiment of this invention.

A glass envelope 10 is provided with a face plate 11, a funnel 12 integrally sealed to this face plate 11, and a neck 14 connected to the funnel.

The inside face of face plate 11 is formed with a phosphor screen 15 for picture display. This phosphor screen is made up of a regular arrangement of phosphor dots or phosphor stripes that emit red, green and blue light. A shadow mask 16 is arranged facing and adjacent to screen 15. Shadow mask 16 normally comprises a thin iron plate of dome shape matching the internal shape of face plate 11, whose portion facing screen 15 is formed with a large number of apertures 16, so arranged that three electron beams 20 impinge correctly on the phosphors of the corresponding color.

An electron gun 17 that generates the three electron beams used for the three colors red, green, and blue is sealed into neck 14. The electron beams 20 are disposed inline in the horizontal direction, i.e. the electron beams lie in the same horizontal plane. The arrangement is such that the electron beams are emitted parallel to each other with a mutual separation of about 6.6 mm. The electron guns are integrated as a single unit comprising electron emitting cathodes and common electrodes of control, screen, focus and convergence cup electrodes. These are supplied with respective prescribed voltages. The potential of the high voltage electrodes as the convergence cup is usually ultra high potential (25 kV). The phosphor screen and shadow mask are maintained at an equivalent potential of 25 kV, the same as the high voltage electrode, by a power source 21.

A deflection device 19 is mounted in the vicinity of the region (usually called the "cone" 13) where neck 14 joins funnel 12.

The picture signal is input between the cathodes and control electrodes corresponding to the respective electron beams. In scanning, if the "blue" beam is the leading beam, passing over the screen first, the blue picture signal is input first across the electrodes. The picture signals of the "green" and "red" beams, which follow the "blue" beam with a certain offset, are then input, as described above, with respective time delays $\tau$ and $2\tau$. These delays are produced by delay element 18.

Figure 3A:
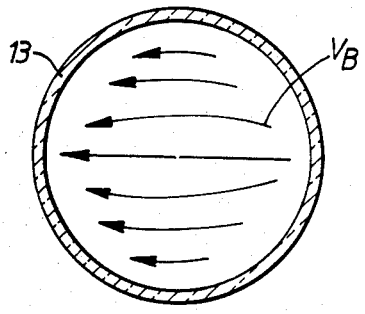
FIG. 3 are cross-sectional views explaining a vertical deflection magnetic field, 3(*a*) is a cross-sectional view along the line B in FIG. 1 and 3(*b*) is a cross-sectional view along the line C in FIG. 1.
Figure 3B:
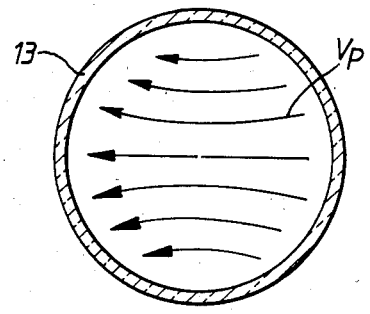

Deflection device 19 comprises a saddle shaped horizontal deflection coil 22 that generates a uniform magnetic field H as shown in FIG. 2. This constitutes the magnetic field that deflects electron beams 20 in the horizontal direction. A toroidal vertical deflection coil 23, which constitutes the field that deflects the beam in the vertical direction, generates a barrel shaped magnetic field $V_B$ as shown in FIG. 3(*a*) on the side of electron gun 17 and a pin-cushion shaped magnetic field $V_P$ as shown in FIG. 3(*b*) on the side of phosphor screen 15 within a space surrounded with coil 23. The deflection coils are designed such that the half-width a of the flux density distribution on the tube axis of the horizontal deflection magnetic field and the vertical deflection magnetic field is 0.25 times the distance A from the center of the flux density distribution to the phosphor screen. Deflection device 19 is driven by deflection driver $\mathbf{19}_1$.

Deflection device 19 may be any type of coils surrounding a cylindrical beam deflection space to generate the horizontal and vertical deflection fields. The typically used coils are a saddle type or a toroidal type. The drive signal fundamentally has a saw tooth current wave.

The deflection coil includes a pair of windings symmetrically facing each other about the tube axis.

The uniform, pin-cushion and barrel field each is selected by an arc angle cross the both sides of the deflection coil winding about the tube axis. The toroidal coil has a uniform field when the angle is about 114°, a pin-cushion field at an angle $<114°$ and a barrel field at an angle $>114°$ (refer to J. Haantjes and G. J. Lubbon, Errors of Magnetic Deflection, II, Philips Research Report 14, pp. 65–97, 1959).

At the gun side of the toroidal vertical deflection coil, a pin-cushion field is generated when the angle is e.g. about 60°, and at the screen side of the toroidal vertical deflection coil, a barrel field is generated when the angle is e.g. about 72°. The amount of the pin-cushion or barrel distortion depends on such angles.

For a 20 inch 90 degree deflection tube, the horizontal width of the picture (phosphor screen) is about 400 mm. If we assume that the horizontal deflection frequency is 15.75 kHz, the amount of mutual offset $\Delta$ of the electron beam spots on the screen is 6.6 mm, and the constant C is 0.75, the time delay of input of the picture signals for the various colors to the respective electron guns is about 0.8 microsecond.

In addition, it was found that $\tau D$ must be $-0.4$ microseconds. The design for the deflection field, the size of the color cathode ray tube and so may require a change to this amount.

The device produces pictures in which the distortion of beam spot core and flare is minimized at both of the center and corner of the screen, bright and with high resolution at the whole screen.

Another embodiment will be now explained.

Figure 11:
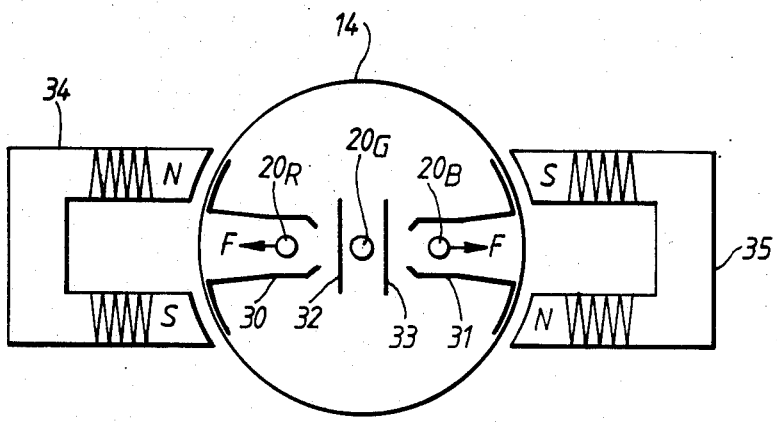
FIG. 11 is a schematic view of one of magnetic field generating means for convergence error correction, observed from the side of the phosphor screen.

$\tau c$ is a set constant. In this case, on the screen a convergence error $\Delta$ occurs in FIG. 10(*b*), in which red pattern Rb by beam 20R and blue pattern Bb by beam 20B are offset from green pattern Gb by beam 20G. FIG. 11 shows magnetic field generating means driven for correction of the convergence error and synchronized with the vertical deflection.

As shown in the figure, pairs of pole pieces 30 and 31 are arranged outside the electron gun in the neck 14 to interpose the side beams 20R and 20B at the upper and lower sides thereof. Additively a pair of magnetic plates 32 and 33 are arranged among the beams 20R, 20G and 20B. Outside neck 14, a pair of U-shaped magnetic field generators 34 and 35 with a coil are assembled symmetrically in the horizointal direction.

As an example, the convergence error as shown in FIG. 10(*b*) will be explained. The electron beam 20R for red shifts to the left side and the electron beam 20B shifts to the right side at the end of the vertical axis of the screen. For correction of the shift, it is necessary that the forces F are applied to separate side beams 20R and 20B from each other as shown in FIG. 11. The magnetic field producing the force F is generated from generators 34 and 35 the coils of which are applied with parabolic shaped current modulated and synchronized with the 2nd power of the vertical deflection amount. The current direction is selected so that the N pole and S pole distribution, as shown in the figure, is obtained. The current intensity is selected to minimize the convergence error on the screen.

In another embodiment of this invention, 26 inch 110 degree deflection tubes were used, while the other conditions were the same as in the preceding embodiment. When an evaluation was made of such color cathode ray tubes with a/A equal to 0.1 and a/A equal to 0.4 respectively, it was found that in both cases better performance was obtained than with a conventional system, in which the horizontal magnetic field is of the pin cushion type. When a/A was set to 0.2 to 0.3, performance was even further improved.

Although in the 20 inch 90 degree deflection tube of the above embodiment, the centers of the horizontal and vertical deflection magnetic fields were set at about 290 mm from the phosphor screen, in another embodiment, the position of the center $H_c$ of the horizontal deflection magnetic field is set at about 285 to 280 mm from the phosphor screen, and the position of the center $V_c$ of the vertical deflection magnetic field is set at about 295 to 300 mm from the phosphor screen. In other words, the center $H_c$ of the horizontal deflection magnetic field is advanced from the center $V_c$ of the vertical deflection magnetic field towards the phosphor screen 15 by an amount in the range 10 to 20 mm. It was found that this resulted in a further substantial improvement in the convergence accuracy attainable with three electron beams.

This invention has been described above under the assumption that, in the undeflected state, the electron beams are practically parallel. This of course includes the case where they are geometrically parallel. However, without departing from the essence of this condition, the invention can of course also be applied to a color cathode ray tube wherein color offset correction is performed by applying constant delay times to the respective color signals, although, under conditions of zero deflection, the three electron beams are actually out of convergence i.e. are substantially non coincident.

Usually a static convergence device is mounted on the electron gun side of the deflection coils and its hexapolar magnetic flux component leaks into the deflection magnetic field. To cancel this leakage component, the deflection field with hexapolar component compensation magnetic field as a result is of course also included in the uniform deflection magnetic field.

We claim:

1. A color cathode ray tube device, comprising:

an enclosed envelope including a face plate, a funnel portion sealed to said face plate and a neck portion connected to said funnel;

a phosphor screen on the inside of said face plate for emitting light in the three colors red, green and blue;

electron gun means in said neck for generating three substantially parallel electron beams in a direction toward said phosphor screen;

a shadow mask disposed in said envelope, including a plurality of apertures for selective impingement of said electron beams on said screen; and deflection means both for deflecting said electron beams from a substantially parallel orientation and for maintaining a substantially equal relative distance between adjacent electron beams at any given point iof intersection of said beams with said phosphor sccreen, said deflection means including; means for generating a horizontal deflection magnetic field having a substantially uniform magnetic field distribution; and means for generating a vertical deflection magnetic field having a first portion of substantially barrel-shaped magnetic field distribution and a second portion of substantially pin-cushion shaped magnetic field distribution.

2. The cathode ray tube device of claim 1 wherein said deflection means includes a magnetic field having a half width of magnetic flux density distribution, measured on the tube axis, in the range of about 0.1 to about 0.4 times the distance from the center of said flux density distribution to said phosphor screen.

3. The cathode ray tube of claim 1, also including time delay means for controlling input of the picture signal received by said device into said electron gun means.

4. The color cathode ray tube device according to claim 1 wherein said vertical deflection magnetic field generating means include a toroidal coil, a major part of said vertical deflection magnetic field being generated within the space surrounded by said toroidal coil.

5. The color cathode ray tube device according to claim 3 wherein said time delay means is modulated and synchronized for compensating for changes in the intensity of said vertical deflection magnetic field.

6. The color cathode ray tube device according to claim 1 wherein said time delay means includes means for setting a constant time delay, and wherein said device also includes convergence error correction means for minimizing the convergence error of the electron beams on said screen.

7. The cathode ray tube device of claim 4 wherein the space surrounded by the toroidal coil is divided into an electron gun means side and a screen side, said first portion of substantially barrel-shaped magnetic field distribution being located on said electron gun means side and said second portion of substantially pin-cushion shaped magnetic field distribution being located on said screen side.

* * * * *